US006914382B2

(12) United States Patent
Ishimoto et al.

(10) Patent No.: US 6,914,382 B2
(45) Date of Patent: Jul. 5, 2005

(54) DISPLAY DEVICE HAVING ARRAY OF ELONGATED DISCHARGE TUBES

(75) Inventors: Manabu Ishimoto, Kawasaki (JP); Tsutae Shinoda, Kawasaki (JP); Akira Tokai, Kawasaki (JP); Hitoshi Yamada, Kawasaki (JP); Kenji Awamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 163 days.

(21) Appl. No.: 10/372,267

(22) Filed: Feb. 25, 2003

(65) Prior Publication Data

US 2003/0184212 A1 Oct. 2, 2003

(30) Foreign Application Priority Data

Mar. 29, 2002 (JP) ..... 2002-095582

(51) Int. Cl.[7] ..... H01J 1/62
(52) U.S. Cl. ..... 313/582; 313/493; 313/607
(58) Field of Search ..... 313/485, 581–582, 313/584, 1, 234, 607, 486, 422, 488, 493, 494, 634

(56) References Cited

U.S. PATENT DOCUMENTS 5,444,335 A * 8/1995 Matsumoto et al. ..... 315/246
5,514,934 A * 5/1996 Matsumoto et al. ..... 313/607
6,650,055 B2 * 11/2003 Ishimoto et al. ..... 313/623
6,677,704 B2 * 1/2004 Ishimoto et al. ..... 313/493

FOREIGN PATENT DOCUMENTS

JP HEI 11-162358 6/1999
JP 11162358 A * 6/1999 ..... H01J/11/02
JP 2000-315460 11/2000

OTHER PUBLICATIONS

U.S. Appl. No. 10/102,869, Ishimoto, et al., filed Mar. 22, 2002.

* cited by examiner

*Primary Examiner*—Nimeshkumar D. Patel
*Assistant Examiner*—Karabi Guharay
(74) *Attorney, Agent, or Firm*—Staas & Halsey LLP

(57) ABSTRACT

A display device includes elongated display tubes each of which has a discharge gas filled and a phosphor layer formed in the tube; a flexible sheet; a plurality of electrodes; and an adhesive layer. Each of the tubes is flat elliptical in cross section and has a plane section. The flexible sheet abuts against the plane sections of the tubes to support the tubes. The plurality of electrodes are arranged on the tubes abutting surface of the flexible sheet, for applying a voltage to the tubes to generate discharges within the tubes. The adhesive layer is disposed on the tubes abutting surface of the flexible sheet to bond the flexible sheet to the plane sections of the tubes so that the electrodes of the flexible sheet face the plane sections when the flexible sheet abuts against the plane sections of the tubes.

24 Claims, 7 Drawing Sheets

DISPLAY DEVICE HAVING ARRAY OF ELONGATED DISCHARGE TUBES

CROSS-REFERENCE TO RELATED APPLICATION

This application is related to Japanese application No. 2002-095582 filed on Mar. 29, 2002, whose priority is claimed under 35 USC §119, the disclosure of which is incorporated by reference in its entirety.

BACKGROUND OF THE INVENTION

1. Field of the Invention

The present invention relates to a display device. More particularly, it relates to a display device in which a plurality of display tubes (gas discharge tubes or light-emitting tubes) constituted of elongated tubes having a diameter of, for example, about 0.5 to 5 mm are arranged parallel to each other for displaying optional images.

2. Description of the Related Art

As display devices as mentioned above, known are a light-emitter and a light-emitting devise disclosed by Japanese Unexamined Patent Publication No. 2000-315460. In this device, a plurality of light-emitting tubes are arranged in parallel on a flat substrate.

SUMMARY OF THE INVENTION

The applicant of the present invention has filed on Mar. 22, 2002, as U.S. patent application Ser. No. 10/102,869, an application of an invention directed to a display device in which a plurality of display tubes constituted of elongated tubes are arranged parallel to each other for displaying optional images.

The above-mentioned display device is illustrated in FIG. 7, wherein reference numeral 31 indicates a front flexible sheet, 32 a rear substrate, 33 a display tube constituted of an elongated tube having a circular cross section, 34 a pair of display electrodes, and 35 a signal electrode.

Inside of the display tube 33, a phosphor layer 36 is formed and a discharge gas is filled. The signal electrodes 35 are formed on the rear substrate 32 longitudinally of the display tubes 33. The display electrode pairs 34 are formed on the front flexible sheet 31 in a direction intersecting the signal electrodes 35.

An area where the signal electrode 35 intersects the display electrode pair 34 is a unit luminous area, when the display device is viewed in plan. Display is performed as follows. Using, as a scanning electrode, either one electrode of the display electrode pair 34, a selective discharge is generated at the area where the scanning electrode intersects the signal electrode 35 so as to select a luminous area. Utilizing, simultaneously with emission of light, a wall charge provided within the tube in the luminous area, display discharges are generated between the display electrode pair 34. A selection discharge is an opposite discharge generated within the tube 33 between the scanning electrode and the signal electrode 35, opposed to each other in a vertical direction. A display discharge is a surface discharge generated within the tube 33 between the display electrode pair 34, disposed parallel to each other on a plane.

In this display device, as mentioned above, the electrodes are arranged outside the tube so that light is emitted from an optional area of the tube. To facilitate this electrode arrangement, the electrodes are formed on both a front substrate and the rear substrate, and the tubes are sandwiched between the substrates to allow contact between the tubes and the electrodes.

Meanwhile, display tubes vary in diameter. Therefore, such a constitution as in the above-mentioned display device has been devised in which a flexible sheet is arranged on a front side of the display device and electrodes are formed on a surface of the flexible sheet facing display tubes. By forming the electrodes of the flexible sheet, it is possible that the contact area between the electrodes and the display tubes is increased and that a variation range in the effective voltage for generating discharges within the display tube is narrowed.

However, where elongated tubes having a circular cross section are used as the display tubes, it is necessary to force the flexible sheet into gaps between adjacent elongated tubes arranged parallel to each other in order to cause the flexible sheet to fit the elongated tubes. Therefore, there has been a demand for a display device which can be readily produced without the need for this procedure.

The present invention has been made under the above circumstances. It is an object of the present invention that by using, as display tubes, elongated tubes having a flat elliptical cross section and bonding a flexible sheet having electrodes formed to the plane sections of the tubes, a contact area between the electrodes and the tubes is increased without forming the electrodes directly on the tubes, and electric discharges generated within the tubes are stabilized.

The present invention provides a display device comprising: elongated display tubes each having a discharge gas filled and a phosphor layer formed therein, each of the tubes being flat elliptical in cross section and having a plane section; a flexible sheet abutting against the plane sections of the tubes to support the tubes; a plurality of electrodes arranged on the tubes abutting surface of the flexible sheet, for applying a voltage to the tubes to generate discharges within the tubes; and an adhesive layer disposed on the tubes abutting surface of the flexible sheet to bond the flexible sheet to the plane sections of the tubes so that the electrodes of the flexible sheet face the plane sections when the flexible sheet abuts against the plane sections of the tubes.

According to the present invention, the flexible sheet is bonded to the plane sections of the tubes such that the electrodes of the flexible sheet face the plane sections of the tubes. According, it is possible to ensure a sufficient contact area between the display electrode pairs and the tubes only by bonding the display electrode pairs to the plane sections of the tubes 1 without causing the front flexible sheet to conform to the tubes. Further, the increase in the contact area between the display electrode pairs and the tubes enhances display luminance in the display device.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Figure 1:
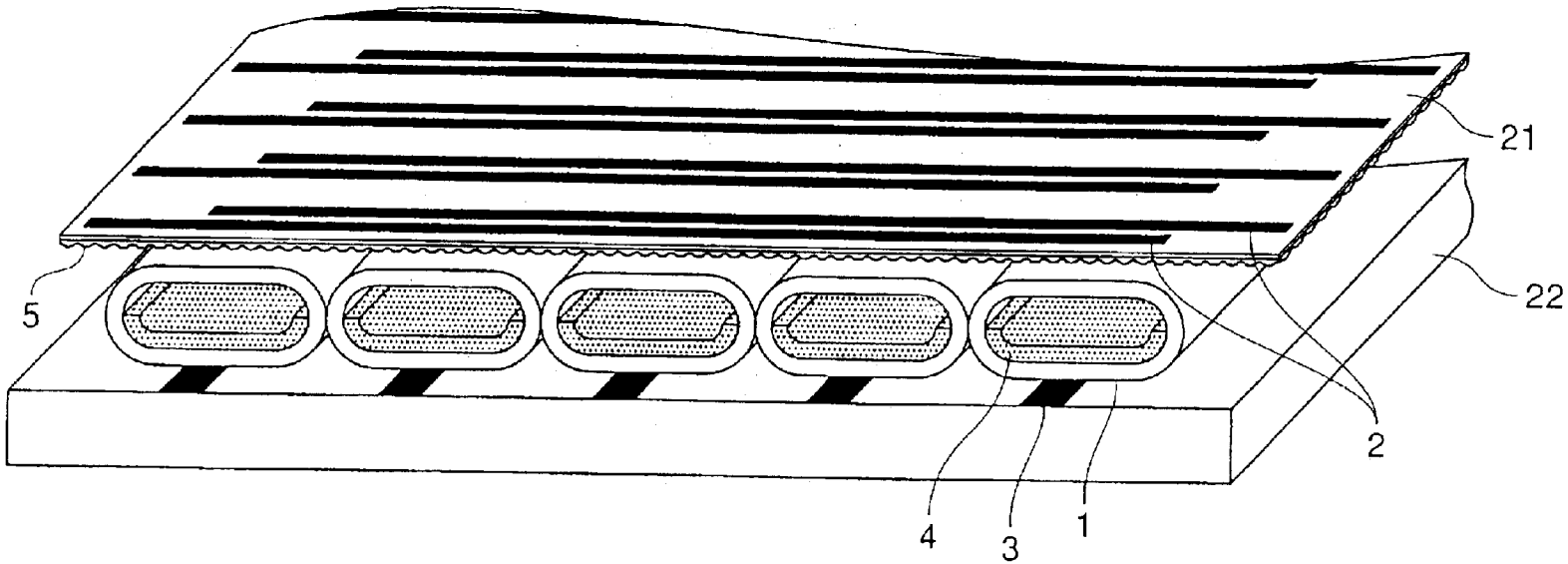
FIG. 1 is an explanatory view illustrating the construction of a display device according to the present invention.

The display device according to the present invention is a device in which a plurality of display tubes having a diameter of about 0.5 to 5 mm, for example, are arranged parallel to each other for displaying optional images. The size of the tube is not particularly limited if the tube is an elongated one having a discharge gas filled and a phosphor layer formed therein, is flat elliptical in cross section, and has a plane section. Also, the material for the tube is not particularly limited.

The flexible sheet may be any kind of sheet known in the art if it can abut against the plane sections of the tubes to support the tubes. As this film, may be used a resin film such as a polycarbonate or a PET (polyethylene terephthalate) film, commercially available, or the like.

The electrodes are not limited if they are formed on the surface of the flexible sheet facing the tubes and if they can generate electric discharges within the tubes by applying a voltage from the outside. The electrodes can be formed on the flexible sheet by a printing method, a vapor deposition method, known in the art, or the like. As the material for the electrodes, can be used various materials known in the art such as Cu, Cr, Al, Au, Ag or the like.

The adhesive layer is not limited if it is formed on the surface of the flexible sheet facing the tubes and if they can bond the flexible sheet to the plane sections of the tubes such that the electrodes on flexible sheet face the plane sections of the tubes. As the material for adhesive layer, can be used various adhesive layer materials such as a resin adhesive which is formed into layer. The thickness of the adhesive layer is not particularly limited and may be any. The adhesive layer is formed of a light-transmittable adhesive.

The adhesive layer can be formed of a thermoplastic, thermosetting, pressure-sensitive or ultraviolet-curing adhesive, or the like. For example, as a transparent adhesive, can be used EXP-90 manufactured by SUMITOMO 3M, or highly transparent adhesive transfer tapes #8141, #8142 or #8161, or the like. EXP-90 is an ultraviolet-curing adhesive, whereas the adhesive transfer tapes #8141, #8142 and #8161 are sheet-formed adhesives, and any of these adhesive has light transmittance as high as 75% or more.

In the present invention, it is desirable that the display device further comprises a supporter abutting against surfaces of the tubes opposite to the plane sections thereof so that the flexible sheet and the supporter sandwich the tubes therebetween.

Further, it is desirable that the flexible sheet is formed of a light-transmittable film sheet and disposed on a display screen side of the display device.

The supporter may be formed of either a rigid substrate or a flexible sheet, and it is desirable that the supporter is arranged on a rear side opposite to the display screen side and has an adhesive layer on the surface facing the tubes. Where the supporter is formed of a rigid substrate, its shape is not particularly limited and can be a flat or curved one.

Also, the present invention provides a display device comprising: a tube array-constituted of elongated display tubes, each having a discharge gas filled and a phosphor layer formed therein, arranged parallel to each other with their plane sections facing the same direction, the tube being flat elliptical in cross section and having a plane section; a flexible sheet abutting against the plane sections of the tubes constituting the tube array to support the tube array; a supporter abutting against surfaces of the tubes constituting the tube array opposite to the plane sections thereof so that the tube array is sandwiched between the flexible sheet and the supporter; a plurality of pairs of display electrodes for generating discharges within the tubes through application of a voltage from the outside of the tubes constituting the tube array, the display electrode pairs being arranged in a direction intersecting the tubes on a surface of the flexible sheet facing the tube array; a plurality of signal electrodes for generating a selective discharge between the signal electrode and an electrode of the display electrode pair, the signal electrodes being formed parallel to the tubes on a surface of the supporter facing the tube array; and an adhesive layer for bonding the flexible sheet to the plane sections of the tubes constituting the tube array so that the electrodes of the flexible sheet face the plane sections when the flexible sheet abuts against the plane sections of the tubes, the adhesive layer being disposed on the surface of the flexible sheet facing the tube array.

In the above construction, it is desirable that the flexible sheet is formed of a light-transmittable film sheet and disposed on a display screen side of the display device.

The supporter may be formed of either a rigid substrate or a flexible sheet, and it is desirable that the supporter is disposed on a rear side opposite to the display screen side and has an adhesive layer on the surface thereof facing the tube array. Where the supporter is formed of a film sheet, it is possible that the film sheet on the rear side and the film sheet on the display side are laminated on the tube array to sandwich the tube array therebetween for allowing the display device to be altered in shape in a direction intersecting the longitudinal direction of the tubes.

In the above construction, it is desirable that the display electrode comprises a transparent electrode and a metal electrode.

The present invention will now be explained in detail based on the preferred embodiments shown in the drawings. It should be understood that the present invention is not limited to the embodiments but various modifications are possible.

FIG. 1 is an explanatory view illustrating the construction of a display device according to the present invention.

In this drawing, reference numeral 1 indicates an elongated tube as a display tube, 2 a pair of display electrodes (a pair of main electrodes), 3 a signal electrode (also referred to as a data electrode or an address electrode), 4 a phosphor layer, 5 a adhesive layer, 21 a front flexible sheet (a flexible sheet on a display screen side of the display device), and 22 a rear substrate.

The display device according to the present invention is constructed such that the plurality of display electrode pairs 2 arranged to come into contact with plane sections of the tubes 1 generate electric discharges, so that light is emitted from the phosphor layer 4 within the tube 1 to give a plurality of luminous points (display areas) within the single tube 1. In this display device, the tubes 1 are formed of a transparent insulating material, have a longer diameter of 5 mm or less, a material thickness of about 100 $\mu$m and a length of 300 mm or more, and are arranged in the form of an array.

The tube 1 is made of borosilicate glass, is flat elliptical in cross section, and has plane sections on its display screen side and on its rear side. The tubes 1 are arranged side by side such that their plane sections are parallel to the rear substrate 22. Inside the tube 1, the phosphor layer 4 is formed and a discharge gas is filled.

The phosphor layer 4 is formed by applying and firing a phosphor paste. As the phosphor paste, various phosphor pastes known in the art can be used.

On internal wall surfaces of the tube 1, there may be provided an electron emission layer for generating charged particles by colliding with a discharge gas having energy above a predetermined value.

Upon application of a voltage to the display electrode pair 2, the discharge gas filled in the tube 1 is excited and, in the deexcitation process of the excited rare gas's atoms, emits vacuum ultraviolet light to excite the phosphor layer 4 for causing it to emit visible light.

The front flexible sheet 21 abuts against the plane sections of the tubes 1 on the display screen side to support the tubes 1 that are arranged in the form of an array.

The front flexible sheet 21 is made of a transparent film sheet which is about 100 $\mu$m thick. As this film, may be used a polycarbonate or a PET (polyethylene terephthalate) film, commercially available, or the like.

Figure 2:
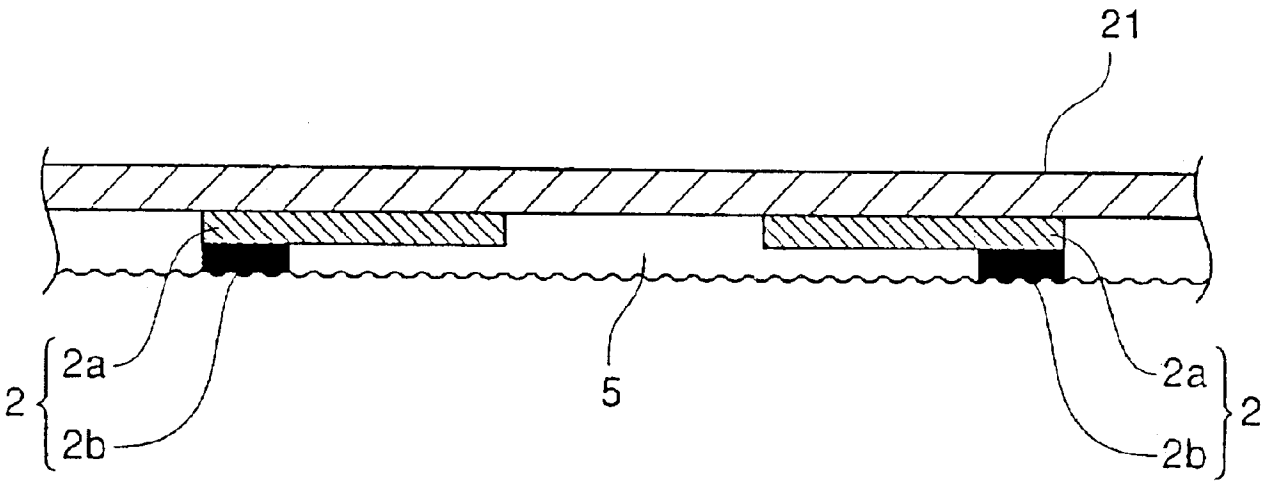
FIG. 2 is a view illustrating display electrode pairs in cross section according to an embodiment of the present invention.

On a surface of the front flexible sheet facing the tubes 1, the plurality of display electrode pairs 2 are formed in a direction intersecting the longitudinal direction of tubes 1. Through application of the voltage to the tube 1 from the outside, the display electrode pairs 2 are for generating electric discharges within each tube 1 for performing display. FIG. 2 is a view illustrating the display electrode pairs 2 in cross section taken along a direction intersecting the longitudinal direction of the display electrode pairs 2. As shown in this drawing, each electrode of the display electrode pair 2 comprises a transparent electrode 2*a* of ITO or the like and a bus electrode 2*b* of a metal such as Cu, Cr or the like. The transparent electrode 2*a* and bus electrode 2*b* are formed by a printing method, a low-temperature sputtering method, known in the art, or the like.

After the display electrode pairs 2 are formed, the adhesive layer 5 is formed on the surface of the front flexible sheet 21 facing the tubes 1. The adhesive layer 5 bonds the front flexible sheet 21 to the plane sections of the tubes 1 such that the display electrode pairs 2 of the front flexible sheet 21 face the plane sections when the front flexible sheet 21 abuts against the plane sections of the tubes 1.

For the adhesive layer 5, may be used an adhesive, an adhesive tape or the like. The adhesive is applied over the entire surface of the front flexible sheet 21. Alternatively, instead of applying the adhesive over the entire surface of the front flexible sheet 21, the adhesive or a double-coated adhesive tape may be placed on the front flexible sheet in gaps between adjacent display electrode pairs (referred to as non-discharge slits since no discharge is generated in these slits). If an adhesive or an adhesive tape of a black or dark color is placed in the non-discharge slits, it can darken the non-discharge slits to improve the contrast in the display device. In this case, apart from an adhesive or an adhesive tape, a black film may be employed.

In this manner, the display electrode pairs 2 are formed on the internal surface of the front flexible sheet 21 and the resultant flexible sheet 21 is bonded to the tubes 1 by such a technique as laminating so that the display electrode pairs 2 come into contact with the plane sections of the tubes 1.

The rear substrate 22 is made of soda lime glass, and abuts against the rear plane sections of the tubes 1. Thus, the rear substrate 22 and the front flexible sheet 21 sandwich the plurality of tubes 1 therebetween.

The front flexible sheet 21 needs to be light-transmittable from the view point of visuality. On the other hand, the rear substrate 22 does not necessarily need to be light-transmittable and rather, it is preferred that the rear substrate 22 has a dark color to improve the contrast in background. Also, it is not necessary that as is glass, the rear substrate 22 should be heat-resistant, since the rear substrate 22 is not subjected to a heat treatment in a later process, and therefore various resins (for example, an acrylic resin) light in weight and easy in processing can be used.

On a surface of the rear substrate 22 facing the tubes 1, the plurality of signal electrodes 3 are formed parallel to the tubes 1. The signal electrodes 3 are for generating a selective discharge between the signal electrode 3 and an electrode of the display electrode pair 2. The signal electrodes 3 are arranged on the rear substrate that does not need to be light-transmittable, and therefore are made only of a metal. The signal electrode is formed by the printing method, the low-temperature sputtering method known in the art, or the like.

After the formation of the signal electrodes, another adhesive layer is disposed on the surface of the rear substrate 22 facing the tubes 1 during an assembly of the display device. For this adhesive layer, can be used the same adhesive as that used for the counterpart disposed on the flexible sheet 21.

Through application of a voltage from the outside of the tube 1, the display electrode pair 2 and the signal electrode 3 can cause the discharge gas filled within the tube 1 to generate electric discharges. In FIG. 1, three electrodes are arranged at one luminous area so that display discharges are generated between the display electrode pair 2, but the manner of generating display discharges is not limited thereto, and display discharges may be generated between the display electrode 2 and the signal electrode 3.

In other words, such a construction may be designed that the display electrode pair 2 is used as one electrode and the display electrode 2 thus obtained is used a scanning electrode, so that selective discharges and display discharges (opposite discharges) are generated between the display electrode 2 and the signal electrode 3.

The rear side of the display device, which is constituted of the substrate in the above construction, may be constituted of a flexible sheet. The rear flexible sheet does not need to be light-transmittable and may be made of the same transparent film sheet as used for the front flexible sheet.

With the tubes 1 sandwiched between the front and rear flexible sheets as described above, the display device can be bent or rolled up in a direction perpendicular to the longitudinal direction of the tubes 1. Therefore, by bending the display device in the direction perpendicular to the longitudinal direction of the tubes 1, the screen size of the display device can be changed. Also, by rolling the display device up, the transportation of it can be facilitated.

Figure 3:
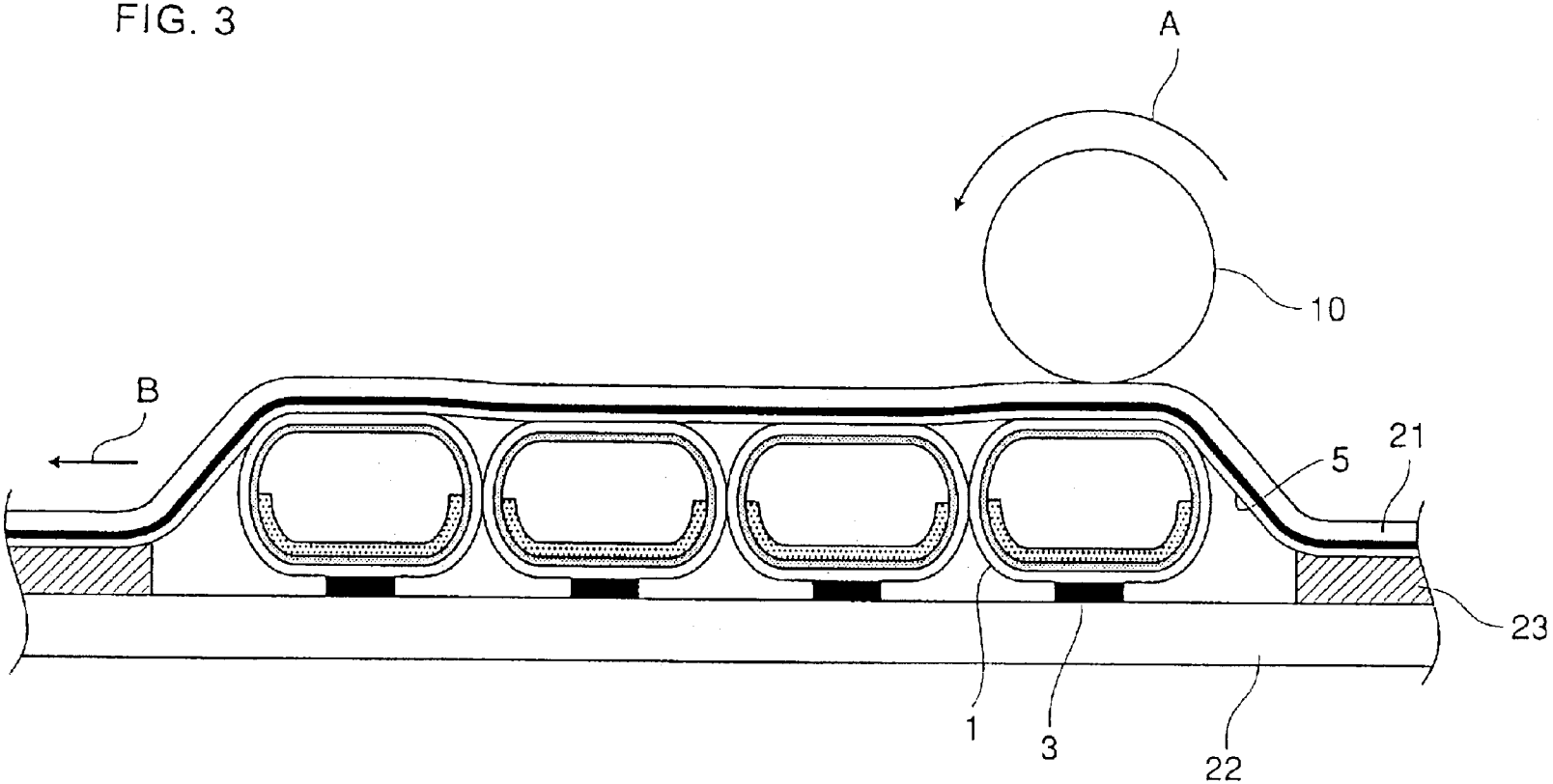
FIG. 3 is a view illustrating an example of a process of bonding a front flexible sheet to tubes according to the embodiment of the present invention.

FIG. 3 is a view illustrating an example of a process of bonding the front flexible sheet to the tubes. In this drawing, reference numeral 23 indicates a spacer.

To bond the front flexible sheet 21 to the tubes 1, a laminator is used to laminate the front flexible sheet 21 on the tubes 1 that are arranged parallel to each other on the rear substrate 22.

For laminating, a tension is placed on the front flexible sheet 21 in the direction of arrow B in FIG. 3, and a resilient roller 10 is moved in the direction intersecting the tubes 1 up to the last tube 1 at either end. During the movement, the roller 10 is rolled in the direction of arrow A while applying a pressure by the roller 10 onto the front flexible sheet 21 toward the tubes 1.

Where a pressure-sensitive adhesive is used for the adhesive layer 5, only application of a pressure to the front flexible sheet 21 by the roller 10 at normal temperature can bond the front flexible sheet 21 to the tubes 1. Where a thermoplastic adhesive is used for the adhesive layer 5, use of a heating roller can bond the front flexible sheet 21 to the tubes 1. The rear side of the display which is constituted of the flexible sheet may be laminated as is the case of the front side.

Figure 4:
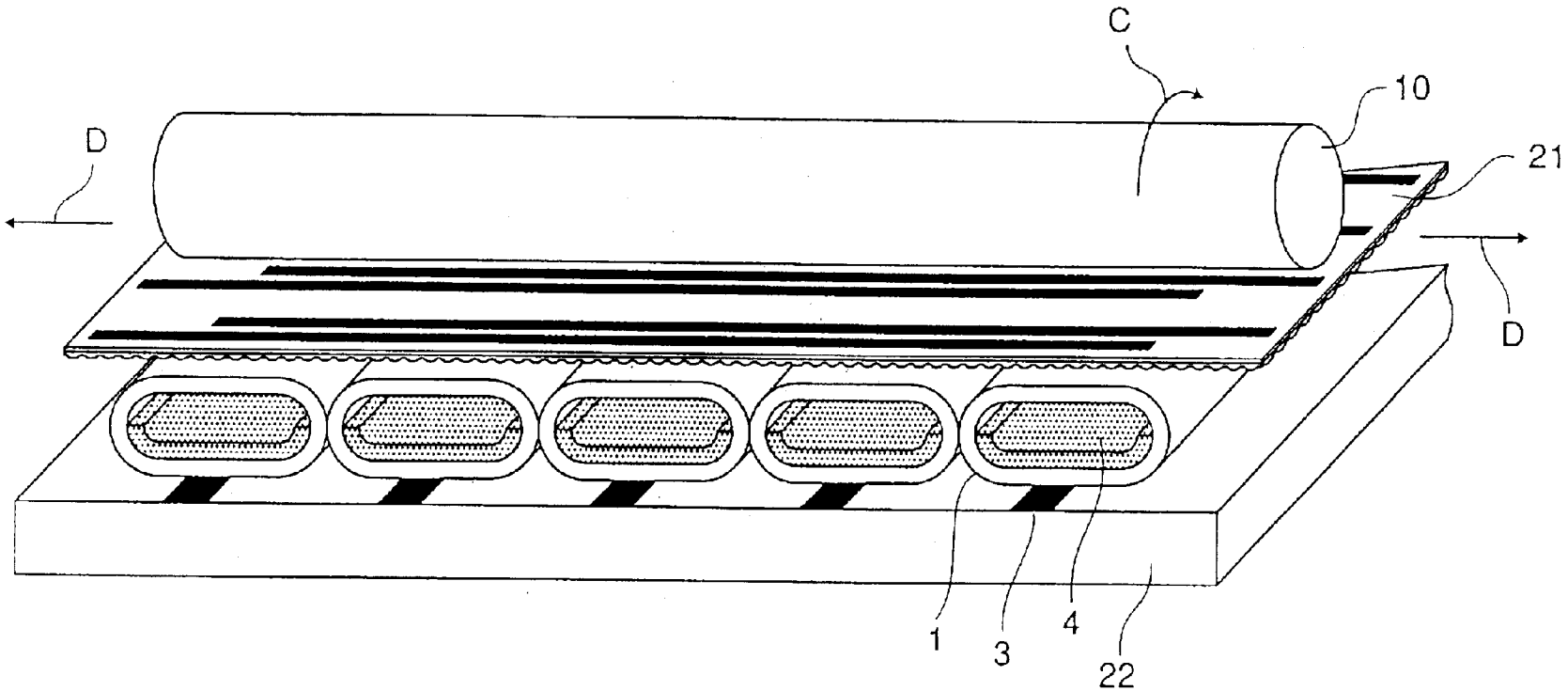
FIG. 4 is a view illustrating another example of the process of bonding the front flexible sheet to the tubes according to the embodiment of the present invention.

FIG. 4 is a view illustrating another example of the process of bonding the front flexible sheet to the tubes.

For laminating the front flexible sheet 21 on the tubes 1, the roller 10 may be moved parallel to the longitudinal direction of the tubes 1. Even if the tubes 1 are slightly different in size, the front flexible sheet 1 can be bonded to the plane sections of the tubes 1 owing to the resilience of the roller 10.

For laminating, a tension is placed on the front flexible sheet 21 in the direction of arrow D in FIG. 4, and the roller 10 is moved along the longitudinal direction of the tubes 1 up to end portions of the tubes 1. During the movement, the roller 10 is rolled in the direction of arrow C while applying a pressure by the roller 10 onto the front flexible sheet 21 toward the tubes 1.

Figure 5:
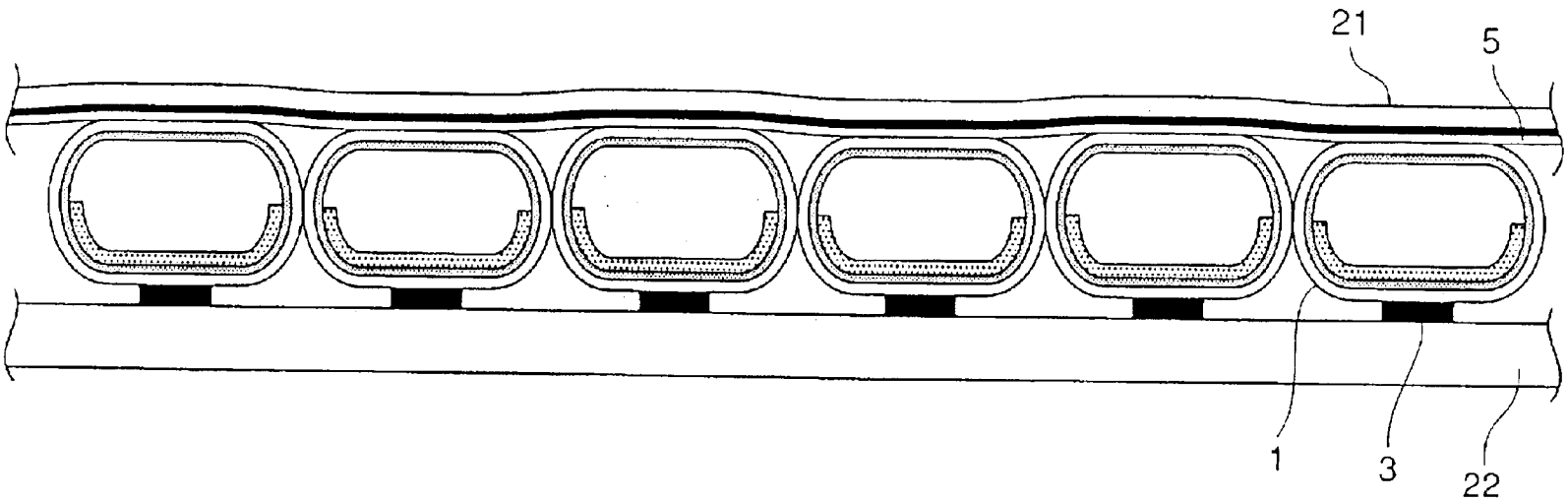
FIG. 5 is a view illustrating an adhesive joint of the front flexible sheet and the tubes bonded together according to the embodiment of the present invention.

FIG. 5 is a view illustrating an adhesive joint of the front flexible sheet and the tubes bonded together in cross section.

As shown in this drawing, even if the tubes 1 are different in size, the front flexible sheet 21 can be bonded to the plane sections of the tubes 1 owing to the lamination procedure as mentioned above.

Figure 6:
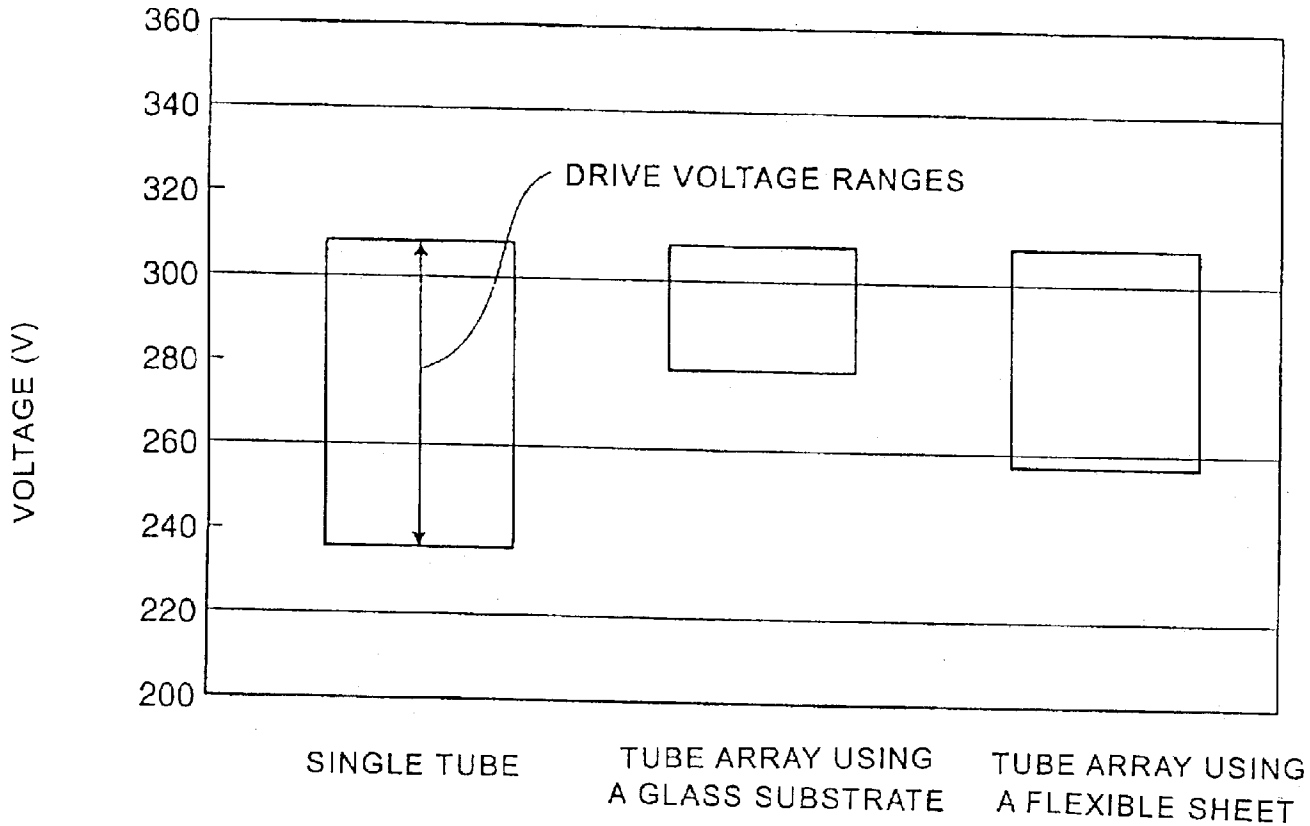
FIG. 6 is a graph illustrating the range of voltages to be applied to the tubes for driving the display device.
Figure 7:
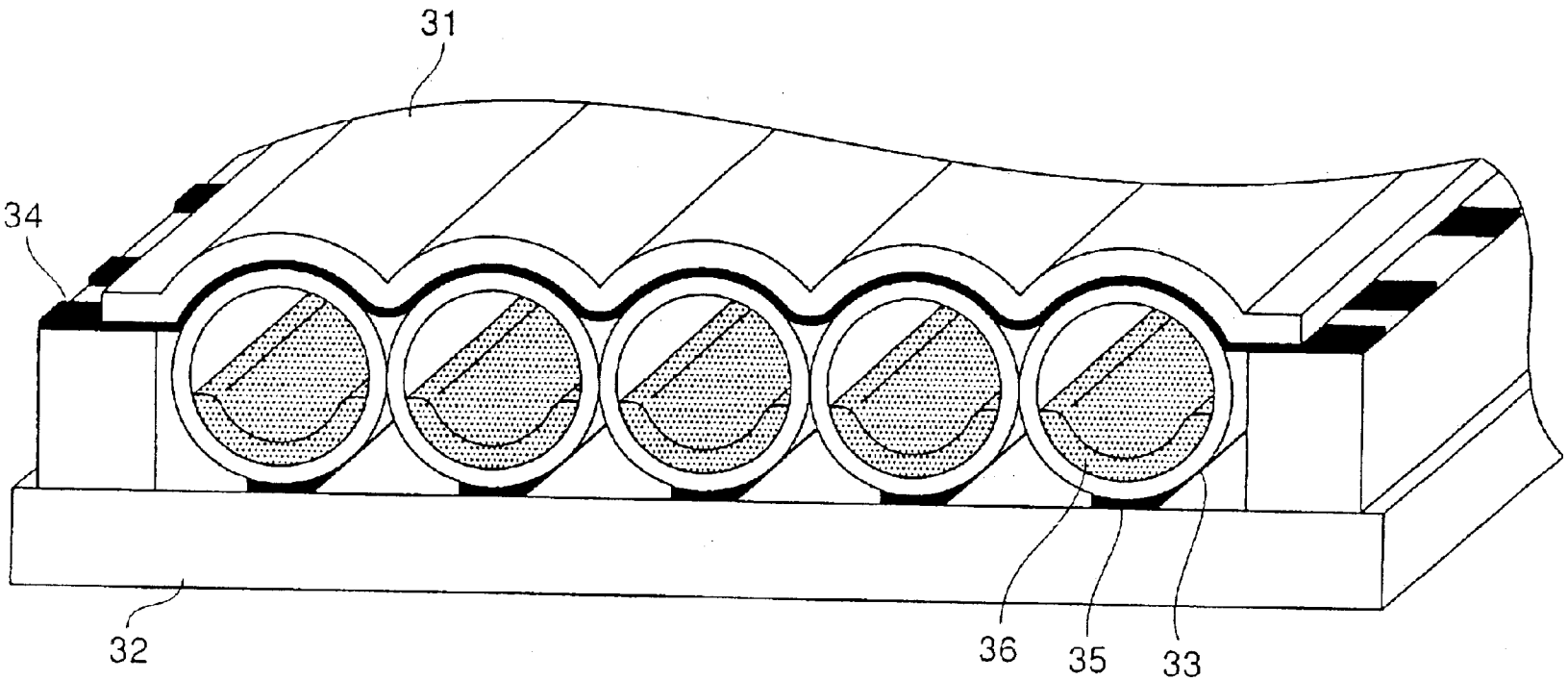
FIG. 7 is a view illustrating a display device of a prior application.

FIG. 6 is a graph illustrating the range of voltages to be applied to the tubes for driving the display device.

In this graph, there are shown cases of a flat elliptical tube having electrodes formed (in the graph, referred to as a single tube), an array of tubes to which was bonded a front substrate of glass having electrodes formed (referred to as a tube array using a glass substrate), and an array of flat elliptical tubes to which was bonded a front substrate of a flexible sheet having electrodes formed (referred to as a tube array using a flexible sheet).

The drive voltage ranges (drive voltage margins or ranges of voltage capable of driving the tube) were between about 240 and 310 volts with the single tube, between 280 and 310 volts with the tube array using the glass substrate, and between 255 and 310 volts with the tube array using the flexible sheet.

Thus, substantially the voltage margin capable of being obtained with the tube array using the flexible sheet was the same as with the single tube.

As described above, in the display device according to the present invention, it is possible to ensure a sufficient contact area between the display electrode pairs 2 and the tubes 1 only by bonding the display electrode pairs 2 to the plane sections of the tubes 1 without causing the front flexible sheet 21 to confirm to the tubes 1. This eliminates the variation in the effective voltage for generating electric discharges within the tubes 1, thereby stabilizing the electric discharges. Further, the increase in the contact area between the display electrode pairs 2 and the tubes 1 enhances display luminance in the display device.

According to the present invention, the electrodes of the flexible sheet face the plane sections of the display tubes. Therefore, the electrodes come into sufficient contact the display tubes to eliminate the variation in the effective voltage for generating discharges within the tubes, thereby stabilizing the electric discharges. Further, the increase in the contact area between the display electrode pairs and the tubes enhances display luminance in the display device.

What is claimed is:

1. A display device comprising:

elongated display tubes each having a discharge gas filled and a phosphor layer formed therein, each of the tubes being flat elliptical in cross section and having a plane section;

a flexible sheet abutting against the plane sections of the tubes to support the tubes;

a plurality of electrodes arranged on the tubes abutting surface of the flexible sheet, for applying a voltage to the tubes to generate discharges within the tubes; and an adhesive layer disposed on the tubes abutting surface of the flexible sheet to bond the flexible sheet to the plane sections of the tubes so that the electrodes of the flexible sheet face the plane sections when the flexible sheet abuts against the plane sections of the tubes.

2. The display device of claim 1, wherein the adhesive layer is formed of a light-transmittable adhesive.

3. The display device of claim 1, further comprising a supporter abutting against surfaces of the tubes opposite to the plane sections thereof so that the flexible sheet and the supporter sandwich the tubes therebetween.

4. The display device of claim 3, wherein the flexible sheet is formed of a light-transmittable film sheet and disposed on a display screen side of the display device.

5. The display device of claim 4, wherein the supporter is formed of a rigid substrate, is provided on a rear side opposite to the display screen side of the display device, and has an adhesive layer on the surface facing the tubes.

6. The display device of claim 4, wherein the supporter is formed of a flexible sheet and disposed on a rear side opposite to the display screen side of the display device.

7. A display device comprising:

a tube array constituted of elongated display tubes, each tube being flat elliptical in cross section and having a plane section, each tube having a discharge gas filled and a phosphor layer formed therein, the tubes being arranged parallel to each other with their plane sections facing the same direction;

a flexible sheet abutting against the plane sections of the tubes constituting the tube array to support the tube array;

a supporter abutting against surfaces of the tubes constituting the tube array opposite to the plane sections thereof so that the tube array is sandwiched between the flexible sheet and the supporter;

a plurality of pairs of display electrodes arranged in a direction intersecting the tubes on a surface of the flexible sheet facing the tube array to generate discharges within the tubes through application of a voltage from the outside of the tubes constituting the tube array;

a plurality of signal electrodes formed parallel to the tubes on a surface of the supporter facing the tube array, each signal electrode to generate a selective discharge between the respective signal electrode and a corresponding pair of display electrodes of the plurality of pairs of display electrodes; and an adhesive layer disposed on the surface of the flexible sheet facing the tube array to bond the flexible sheet to the plane sections of the tubes constituting the tube array so that the display electrodes face the plane sections of the tubes when the flexible sheet abuts against the plane sections of the tubes.

8. The display device of claim 7, wherein the flexible sheet is formed of a light-transmittable film sheet and disposed on a display screen side of the display device.

9. The display device of claim 8, wherein the supporter is formed of a rigid substrate, is disposed on a rear side opposite to the display screen side, and has an adhesive layer on the surface facing the tube array.

10. The display device of claim 8, wherein the supporter is disposed on a rear side opposite to the display screen side, is formed of a film sheet, and laminated on the tube array, whereas the film sheet on the display screen side is also laminated on the tube array, so that the film sheets on the rear side and the display side sandwich the tube array therebetween for allowing the display device to be altered in shape in a direction intersecting the longitudinal direction of the tubes.

11. The display device of claim 7, wherein the display electrode comprises a transparent electrode and a metal electrode.

12. A display device comprising:

elongated display tubes each having a discharge gas filled and a phosphor layer formed therein, each of the tubes having a plane section;

a flexible sheet having a surface abutting against the plane sections of the tubes to support the tubes;

electrodes arranged on the abutting surface of the flexible sheet, to apply a voltage to the tubes to generate discharges within the tubes; and an adhesive layer disposed on the abutting surface of the flexible sheet to bond the flexible sheet to the plane sections of the tubes so that the electrodes face the plane sections when the flexible sheet abuts against the plane sections.

13. The display device of claim 12, wherein the adhesive layer is formed of a light-transmittable adhesive.

14. The display device of claim 12, further comprising a supporter abutting against surfaces of the tubes opposite to the plane sections thereof so that the flexible sheet and the supporter sandwich the tubes therebetween.

15. The display device of claim 14, wherein the flexible sheet is formed of a light-transmittable film sheet and disposed on a display screen side of the display device.

16. The display device of claim 15, wherein the supporter is formed of a rigid substrate, is provided on a rear side opposite to the display screen side of the display device, and has an adhesive layer on a surface facing the tubes.

17. The display device of claim 15, wherein the supporter is formed of a flexible sheet and disposed on a rear side opposite to the display screen side of the display device.

18. A display device comprising:

a tube array comprising elongated display tubes, each tube having a plane section, each tube having a discharge gas filled and a phosphor layer formed therein, the tubes being arranged parallel to each other with their plane sections facing a same direction;

a flexible sheet having a surface abutting against the plane sections of the tubes to support the tube array;

a supporter abutting against surfaces of the tubes opposite to the plane sections thereof so that the tube array is sandwiched between the flexible sheet and the supporter;

a plurality of pairs of display electrodes arranged in a direction intersecting the tubes on the abutting surface of the flexible sheet to generate discharges within the tubes through application of a voltage from outside of the tubes;

a plurality of signal electrodes formed parallel to the tubes on a surface of the supporter facing the tube array, each signal electrode to generate a selective discharge between the respective signal electrode and a corresponding pair of display electrodes of the plurality of pairs of display electrodes; and an adhesive layer disposed on the abutting surface of the flexible sheet to bond the flexible sheet to the plane sections of the tubes so that the plurality of pairs of display electrodes face the plane sections when the flexible sheet abuts against the plane sections.

19. The display device of claim 18, wherein the flexible sheet is formed of a light-transmittable film sheet and disposed on a display screen side of the display device.

20. The display device of claim 19, wherein the supporter is formed of a rigid substrate, is disposed on a rear side opposite to the display screen side, and has an adhesive layer on a surface facing the tube array.

21. The display device of claim 19, wherein the supporter is disposed on a rear side opposite to the display screen side, is formed of a film sheet, and laminated on the tube array, whereas the film sheet on the display screen side is also laminated on the tube array, so that the film sheets on the rear side and the display side sandwich the tube array therebetween for allowing the display device to be altered in shape in a direction intersecting the longitudinal direction of the tubes.

22. The display device of claim 18, wherein the each pair of display electrodes comprises a transparent electrode and a metal electrode.

23. A display device comprising:

elongated display tubes each having a discharge gas filled and a phosphor layer formed therein, each of the tubes having a plane section;

a flexible sheet having a surface abutting against the plane sections of the tubes;

electrodes arranged on the abutting surface of the flexible sheet and facing the plane sections of the tubes; and an adhesive layer disposed on the abutting surface of the flexible sheet and bonding the flexible sheet to the plane sections of the tubes.

24. A display device comprising:

elongated display tubes each having a plane section, each tube having a discharge gas filled and a phosphor layer formed therein, the tubes being arranged parallel to each other with the plane sections facing a same direction;

a flexible sheet having a surface abutting against the plane sections of the tubes;

a supporter abutting against surfaces of the tubes opposite to the plane sections so that the tubes are sandwiched between the flexible sheet and the supporter;

a plurality of pairs of display electrodes arranged in a direction intersecting the tubes on the abutting surface of the flexible sheet and facing the plane sections of the tubes;

a plurality of signal electrodes formed parallel to the tubes on a surface of the supporter facing the tube array; and an adhesive layer disposed on the abutting surface of the flexible sheet to bond the flexible sheet to the plane sections of the tubes.

* * * * *